United States Patent [19]

Fähnrich

[11] Patent Number: 4,460,848

[45] Date of Patent: Jul. 17, 1984

[54] STARTER CIRCUIT FOR A LOW PRESSURE DISCHARGE LAMP

[75] Inventor: Hans-Jürgen Fähnrich, Munich, Fed. Rep. of Germany

[73] Assignee: Patent-Treuhand-Gesellschaft für Elektrische-Glöhlampen, Munich, Fed. Rep. of Germany

[21] Appl. No.: 326,498

[22] Filed: Dec. 2, 1981

[30] Foreign Application Priority Data

Dec. 16, 1980 [DE] Fed. Rep. of Germany ..... 3047289

[51] Int. Cl.[3] ..... H05B 39/00; H05B 41/14

[52] U.S. Cl. ..... 315/101; 315/151; 315/DIG. 5

[58] Field of Search ..... 315/151, 157, 159, 309, 315/DIG. 5, DIG. 7, 101, 106

[56] References Cited

U.S. PATENT DOCUMENTS 3,919,590 11/1975 Remery et al. ..... 315/DIG. 5
4,358,711 11/1982 Bex ..... 315/309

FOREIGN PATENT DOCUMENTS 1952697 10/1972 Fed. Rep. of Germany .

*Primary Examiner*—David K. Moore

*Assistant Examiner*—Robert E. Wise

*Attorney, Agent, or Firm*—Frishauf, Holtz, Goodman & Woodward

[57] ABSTRACT

Connected in parallel to the lamp through a fuse (10) is a triac (2) the control electrode of which is connected through a diac (3) to the tap (4) of a voltage divider likewise in parallel with the lamp. The first branch of the voltage divider contains, in addition to a fixed resistor (5), at least one variable series impedance (6) which may be either a capacitor or a voltage-dependent resistor. The second branch of the voltage divider is provided by a capacitor (7). A temperature dependent NTC resistance (8) bridges a portion of the first branch and all of the second branch of the voltage divider. For use with ballasts containing a choke, it is desirable to interpose a diode bridged by a NTC resistor in the first branch of the voltage divider adjacent to the tap. An anti-interference capacitor (9) is connected across the triac and can be replaced by a capacitive voltage divider for use with lamps of higher ignition voltage, in which case one capacitive branch of the capacitive voltage divider is bridged by a self-switching four-layer diode, to which it is possible to add a small series inductor. The starter circuit is suitable for a wide range of operating conditions of the lamp.

13 Claims, 5 Drawing Figures

STARTER CIRCUIT FOR A LOW PRESSURE DISCHARGE LAMP

This invention relates to a starting circuit for a low presure discharge (e.g. fluorescent) lamp in which a triac is connected in parallel to the low pressure discharge lamp and in series with the heater electrodes, and the triac is connected by its gate terminal via a diac to the junction of a voltage divider that is also connected in parallel to the low pressure discharge lamp, the first branch of the voltage divider comprising a fixed resistor and the other branch being formed by a capacitor.

A starting circuit of this type is described in German published patent application DE-AS No. 1 952 697. The circuit variants of FIGS. 2, 3 and 4 thereof all comprise a voltage divider in parallel with the terminals A' and B' of the triac 10. The diac 11, which is arranged in the control circuit of the triac, taps with its second terminal the voltage drop across the capacitor 12, which forms the second branch of the voltage divider. The differences show up in the first branch of the voltage divider. The aim in each case is to obtain certain characteristics of the starting circuit by a series arrangement of different functional element groups. The above publication describes in detail the particular importance of the capacitor 14: in order to prevent the repetition of the starting process of an already ignited low pressure discharge lamp, the capacitor 14 must be critically dimensioned so that the starting voltage of the diac 11 will not quite be attained in the presence of operating voltage of a functioning low pressure discharge lamp.

In the circuit example of FIG. 4 of the cited prior disclosure, the capacitor 14 which serves to switch off the starting pulses is bridged by a resistor 18 which also critically influences the switch-off effect of the capacitor. In that FIG. 4, a diode 17 is connected in parallel to the resistor 13. When an inductive ballast is used, this results in an out-of-balance loading of the choke 4 (FIG. 6) and thus in an increased preheating current of the electrode coils 2 and 3. In the non-conducting direction of the diode 17, however, there flows a certain counter current via the resistor 13, which in turn causes a certain magnetic reversal of the choke 4 and reduces the preheating current.

THE INVENTION

It is an object of the invention to provide a starting circuit by which a low pressure discharge lamp is started gently with reliable and fast preheating of the electrode coils and which provides, after lamp ignition, the reliable prevention of further starting attempts. It is a further object of the invention that the starting circuit should be suitable for use under varying operating conditions, such as varying ambient temperatures or with different ballasts provided for the low pressure discharge lamp.

Briefly, the first branch of the voltage divider across the lamp (to the tap of which the diac is connected) comprises at least one variable impedance which may be a capacitor or a voltage-dependent resistor, and, in addition, parts of the first branch of the voltage divider and the second branch of the voltage divider are bridged by an additional variable impedance, typically a NTC resistor, to suppress superfluous restart attempts. The first-mentioned variable impedance forms a series circuit (in the v.d. first branch) with a fixed value resistor and has one terminal connected to the triac. The additional variable impedance bridges, apart from the second branch of the voltage divider which is formed by the capacitor, also the fixed resistor of the first branch of the voltage divider. A circuit arrangement of this type is particularly suitable for instance for compact low pressure discharge lamps having short discharge arcs and operating voltages below 60 V, in which case the ballast is preferably constituted by a series arrangement of an ohmic resistor and a capacitor.

In a modified version of the starting circuit of the invention, a parallel combination of third variable impedance and a diode, having one terminal connected to the diac, is interposed in series with the first branch of the voltage divider. This circuit modification is designed for the starting of conventional low pressure discharge lamps having a ballast consisting of a choke or of a choke and a series capacitor. The diode causes a surge of preheating current, and an NTC resistor connected in parallel therewith reduces the preheating current to normal values after the lamp has started.

In the above-described starting circuits, operating with the ballasts associated therewith, the first variable resistor in the first branch of the voltage divider is in one embodiment a frequency-dependent impedance, like a capacitor, which has a low resistance during the preheating of the electrode coils and a high resistance after the low pressure discharge lamp has started. In another circuit embodiment, the frequency-dependent resistor is replaced by a voltage-dependent resistor. The additional (second) variable impedance which bridges the capacitor of the second branch and a part of the first branch in this case has its connection to the first branch attached between the fixed resistor and the parallel circuit formed by the diode and the third variable impedance.

The third variable impedance of the circuit, located in the first branch of the voltage divider, and the second variable impedance bridging the capacitor of the second branch and a part of the first branch are both temperature-dependent resistors having a negative temperature coefficient. Their functions will be more closely explained hereinafter.

An anti-interference capacitor is connected in parallel to the triac. In special cases—for instance with low pressure discharge lamps which are difficult to start—the anti-interference capacitor is designed as a capacitive voltage divider, to the midpoint of which is connected a self-interrupting four-layer diode whose other terminal is connected to one of the end points of the capacitive voltage divider. A still higher starting voltage may be obtained by adding a small inductor in series with the self-switching four-layer diode.

Short starting periods may be obtained for low pressure discharge lamps with the starting circuit of the invention. The electrode coils are preheated well since, in order to avoid cold starts, low peak values are initially applied which increase with each cycle until starting is reliably effected, a mode of operation which is decisive for long lamp life. When the lamp fails to start the preheating current is switched off within about one second and further starting attempts are prevented. The ballast and the lamp are thus protected.

The starting circuit of the invention may be adapted with few slight extensions or modifications to different ballasts and low pressure discharge lamps of different starting voltage. The few electronic components involved may be readily incorporated in a conventional casing for a starter or may be arranged—with or without ballast—in the lamp itself, thus making the starting circuit suitable also for compact low pressure discharge lamps.

THE DRAWINGS

The invention is further described by way of illustrative examples with reference to the annexed drawings, in which.

DESCRIPTION OF THE ILLUSTRATED EMBODIMENTS

Figure 1:
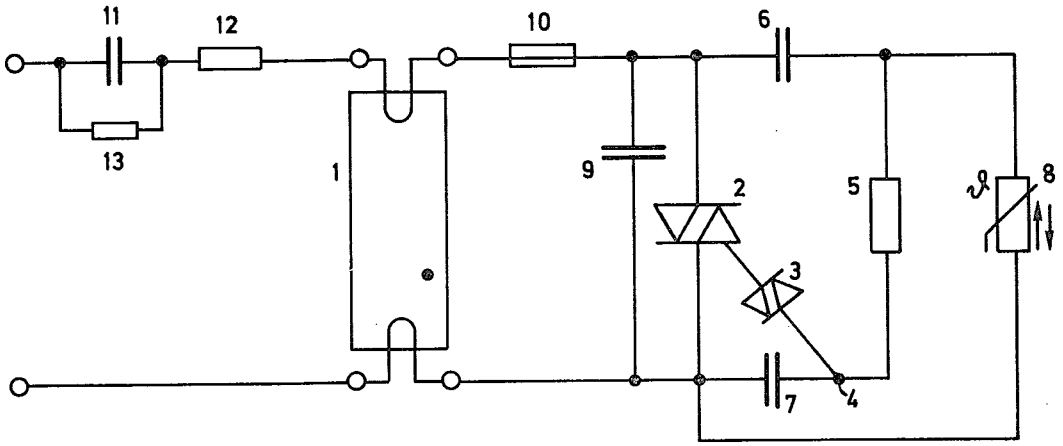
FIG. 1 is a basic circuit diagram of a starting circuit in accordance with the invention.
Figure 2:
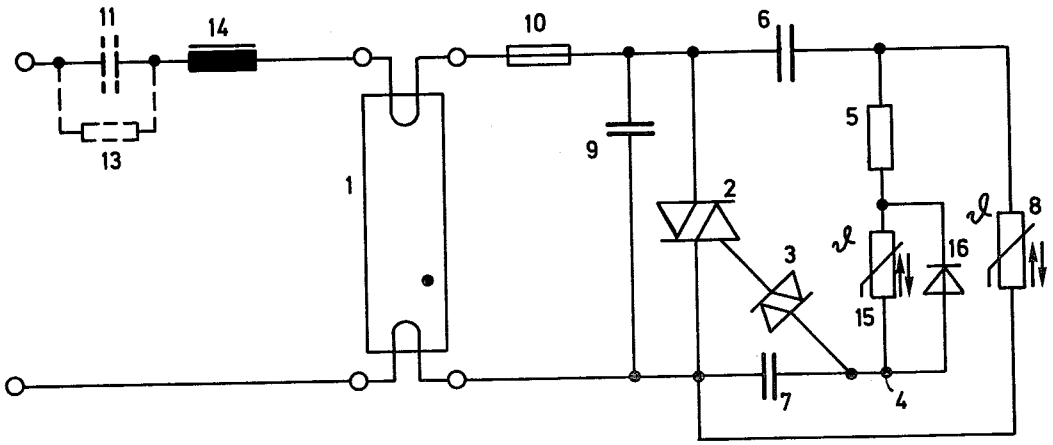
FIG. 2 is a diagram of a modification or elaboration of the circuit of FIG. 1.

In FIG. 1, a triac 2 is connected in parallel with the fluorescent lamp 1 (the resistor 10 being merely a fuse for safety). The gate terminal of the triac 2 is connected via a diac 3 to the tap 4 of a voltage divider that is in parallel with the triac 2. The voltage divider has two branches (legs), the first of which is a series circuit constituted by a charging resistor 5 and a frequency-dependent resistor in the form of a control capacitor 6. The other branch is formed by a trigger capacitor 7. The trigger capacitor 7 and the charging resistor 5 are bridged by an NTC resistor 8 that performs a starter shut-down function. Further, an anti-interference capacitor 9 is connected in parallel to the triac 2. The ballast for limiting the current of the fluorescent lamp 1 is formed by the series circuit of an operating capacitor 11 and a loss resistor 12. A discharging resistor 13 is connected parallel to the operating capacitor 11.

The operation of the starting circuit may be described as follows: the trigger capacitor 7 is charged via the charging resistor 5 and in addition via the control capacitor 6. The triac 2 is controlled via the diac 3 by partial discharging of the trigger capacitor 7; the size of the charging resistor 5 determines the charging period of the trigger capacitor 7 and thus the moment of energization of the triac 2. Moreover, the charging period of the trigger capacitor 7 is influenced by the shut-down NTC resistor 8. The shut-down NTC resistor 8 fulfils two tasks: first, by its change of resistance the switching instant of the triac 2 is modified. This permits, in order to avoid cold starting of the fluorescent lamp 1, provision of a low peak voltage value when applying the line voltage and increasing the peak voltage after the preheating of the electrodes, so that starting will take place reliably. Second, the shut-down NTC resistor 8 is so designed that when the fluorescent lamp 1 fails to start the resistance reduction in resistor 8 switches off the preheating current within one second. The heating of the shut-down NTC resistor 8 is produced by means of a control capacitor 6, as a result of the frequency-dependent impedance of capacitors. As long as the preheating current flows through the electrode coils of the fluorescent lamp 1, small voltage pulses of higher frequency result and, owing to the low resistance of the control capacitor 6 at higher frequency, faster heating of the NTC resistor 8 is achieved. In the event the fluorescent lamp fails to start—for instance at the end of its life—only the 60 Hz line voltage is applied to the control capacitor 6 after the preheating current is switched off. The control capacitor 6 is so dimensioned that this current flowing through it is sufficient to keep the heated shut-down NTC resistor 8 in a low-ohmic state. After switching off the line voltage and cooling-down of the shut-down NTC resistor 8, the starting circuit becomes operational again.

A further advantage of this starting circuit is that, owing to the shut-down NTC resistor 8, half-cycle operation of fluorescent lamps at the end of their life is prevented with circuits in accordance with FIG. 1, because this resistor is heated in such a way that the triac 2 is blocked.

The same starting circuit may be utilized when inductive or capacitive ballasts in accordance with the FIGS. 2 to 5 are used which comprise a series circuit of an operating capacitor 11 and a choke 14. For solely inductive ballasts with a normal choke 14, the starting circuit may be improved by a slight modification to provide a rapid-start starting circuit. In the first branch of the voltage divider, there is additionally connected the parallel combination of a diode 16 and a bridging NTC resistor 15, interposed between the junction 4 and the charging resistor 5. The polarity of the diode 16 may be arbitrary. The diode causes a one-sided controlling of the triac 2 and thus a highly abnormal preheating current of the electrode coils. The bridging NTC resistor 15 reduces the abnormal preheating current within half a second to normal values. It thus permits normal preheating of the electrode coils also in capacitive ballasts.

Figure 3:
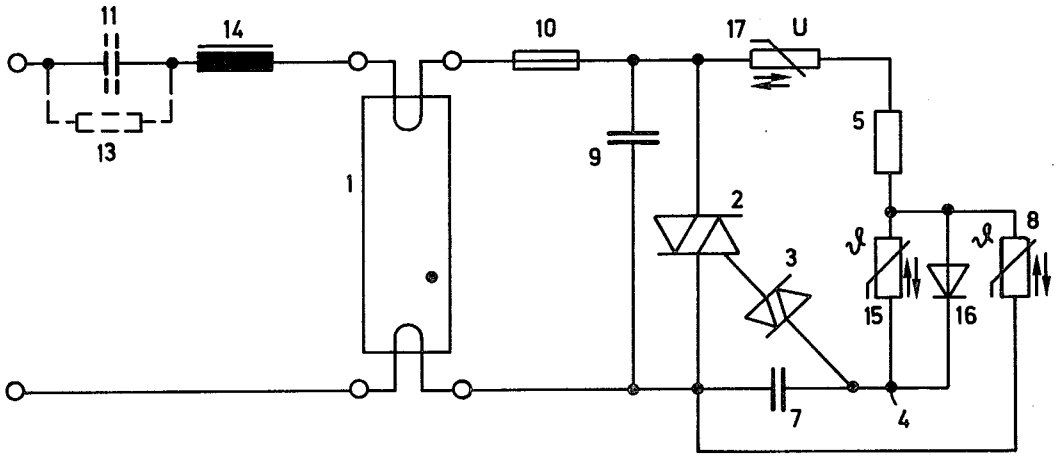
FIG. 3 is a diagram of an alternative embodiment of the circuit of FIG. 2.
Figure 4:
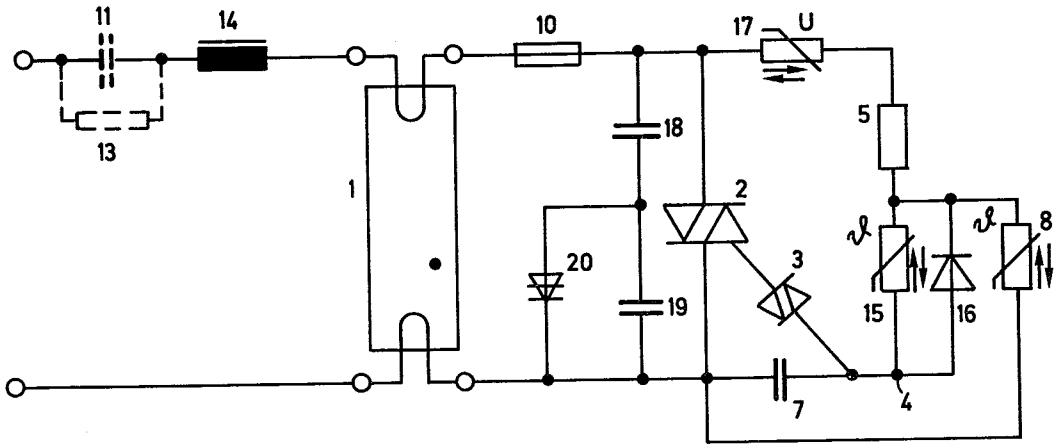
FIG. 4 is a diagram of a modification of the circuit of FIG. 3.

As illustrated in the circuit examples of FIGS. 3 and 4, the control capacitor may also be replaced by a voltage-dependent resistor 17. Its size is selected so that, on the one hand, a safe response of the starting circuit is assured prior to the starting of the lamp and, on the other hand, the starting circuit is kept inoperative after the lamp has started. The connection of the shut-down NTC resistor 8 is made in this case at the junction of the charging resistor 5 and the parallel combination of the NTC resistor 15 and the diode 16. Thus, a simple mode is provided for preventing an excess stress on the bridging NTC resistor 15 after the change to low-resistance values. The value of the voltage available for lamp starting with inductive and capacitive ballasts depends, in the circuit examples of the FIGS. 2 and 3 only, on the capacitance of the anti-interference capacitor 9. With a capacitance of, for instance, $\leqq 10$ nF the peak value of the line voltage is reached. When the capacitance of the anti-inteference capacitor is raised to, for instance, 47 nF, a peak value of the open-circuit voltage of about 400 V results which is sufficient for starting lamps which start normally.

Figure 5:
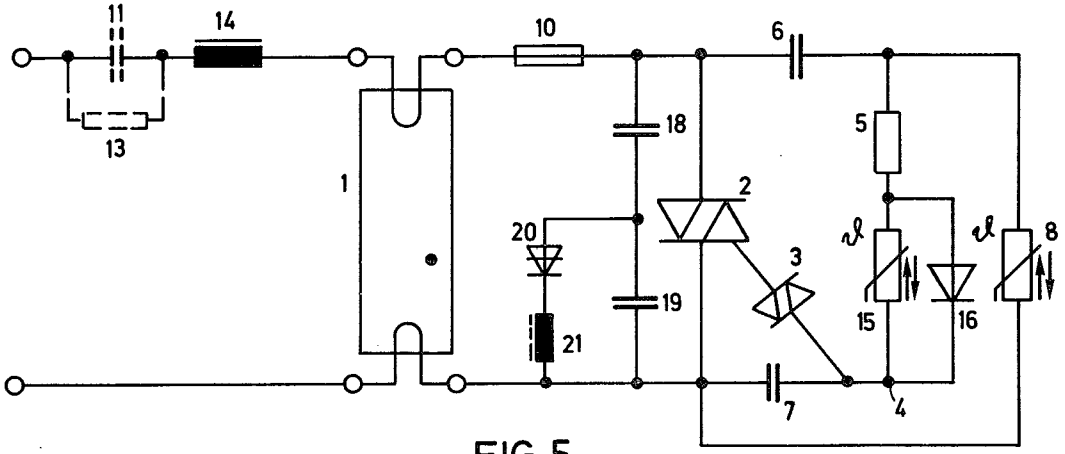
FIG. 5 is a diagram of a modification of the circuit of FIG. 2.

For fluorescent lamps which are difficult to start, the circuit requires modification in accordance with FIGS. 4 or 5. Here, the anti-interference capacitance is designed as a capacitive voltage divider and comprises the series capacitors 18 and 19.

A self-switching four-layer diode 20 is connected to the mid-point of this voltage divider. Its other terminal is connected to either end of the voltage divider. With a circuit as shown in FIG. 4, peak values of around 600 V may be obtained.

Voltages with peak values of around 800 V may be obtained for instance with circuit in accordance with FIG. 5. Here, a small inductor 21 is connected in series with the self-switching four-layer diode 20, the inductor 21 permitting a reverse charging of the series capacitor 19 associated with it.

Although the invention has been described with reference to particular illustrative circuits, it will be understood that further variations and modifications are possible within the inventive concept.

I claim:

1. A starting circuit for a low-pressure discharge lamp comprising a triac connected in parallel to the discharge bath of said low-pressure discharge lamp and in series with the heater electrodes of said lamp, a voltage divider connected in parallel to said lamp in the same manner as said triac and having a tap at the junction of a first branch of said divider and a second divider branch constituted by a capacitor, a diac connected for control of said triac between the gate electrode of said triac and the tap of said voltage divider, and further comprising at least one circuit element (6, 17) having an impedance which is variable with circuit operating circumstances, being provided in said first branch of said voltage divider in series with said fixed resistor, and, a second circuit element of circumstantially variable impedance (8), which has a temperature-dependent resistance, bridged across said capacitor of said second branch and a portion of said first branch of said voltage divider.

2. A starting circuit as claimed in claim 1 wherein said variable impedance element in said first branch of said voltage divider has one terminal which is connected to said triac (2).

3. A starting circuit as defined in claim 2, wherein a parallel combination of a diode (16) and a third circuit element (15) of circumstantially variable impedance, having one terminal connected to said diac, is interposed in said first branch of the voltage divider between said tap and the remainder of said first branch.

4. A starting circuit as defined in claim 3, wherein said second variable impedance element (8) bridges said second branch of the voltage divider and said parallel combination of said third variable impedance element (15) and said diode (16) of said first branch of the voltage divider.

5. A starting circuit as defined in claim 3, wherein said second variable impedance element (8) bridges said second branch of the voltage divider and also both said fixed resistor (5) and said parallel combination of said third variable impedance element (15) and said diode (16) in said first branch of the voltage divider.

6. A starting device as defined in any one of claims 1 to 5, wherein the said first variable impedance element is an element (6) having a frequency-dependent impedance.

7. A starting circuit as claimed in any one of claims 1 to 5, wherein said first variable impedance element is an element (17) having a voltage-dependent resistance.

8. A starting device as defined in any one of claims 1 to 5, wherein said third variable impedance element is a temperature-dependent resistor (15) having a negative temperature coefficient.

9. A starting device as defined in any one of claims 1 to 5, wherein said second variable impedance element is a temperature-dependent resistor (8) having a negative temperature coefficient.

10. A starting circuit as defined in any one of claims 1 to 5, wherein a fuse element (10) is interposed between said lamp and one common terminal of said triac and of said voltage divider.

11. A starting circuit as defined in claim 1, wherein an anti-interference capacitance (9) is connected in parallel to said triac (2).

12. A starting circuit as defined in claim 11, wherein said anti-interference capacitance is provided by a capacitive voltage divider (18, 19) having a midpoint tap between which and one end point of the capacitive voltage divider there is connected a self-interrupting four-layer diode (20).

13. A starting circuit as defined in claim 12, wherein an inductor (21) is interposed in series with said self-interrupting four-layer diode (20) between said tap and end point of said capacitive voltage divider.

* * * * *